United States Patent [19]

Garbe

[11] 4,155,143

[45] May 22, 1979

[54] SEPARABLE HANDLE FOR CLEANER

[75] Inventor: Heinz-Siegfried Garbe, Canton, Ohio

[73] Assignee: The Hoover Company, North Canton, Ohio

[21] Appl. No.: 862,011

[22] Filed: Dec. 19, 1977

[51] Int. Cl.[2] ..... A47L 9/32

[52] U.S. Cl. ..... 15/410; 15/143 R; 15/340; 16/110 R; 280/47.37 R

[58] Field of Search ..... 16/110 R; 280/47.37; 15/143 R, 410, 350, 351, 340

[56] References Cited

U.S. PATENT DOCUMENTS

| | | | |
|---|---|---|---|
| 2,039,861 | 5/1936 | Watts | 15/410 |
| 2,218,160 | 10/1940 | Becker | 15/410 |
| 2,243,067 | 5/1941 | Berg | 15/410 |
| 2,709,273 | 5/1955 | Kelly et al. | 15/410 X |
| 3,273,194 | 9/1966 | Jepson et al. | 15/410 X |

*Primary Examiner*—Christopher K. Moore
*Attorney, Agent, or Firm*—The Hoover Company

[57] ABSTRACT

A handle which may be used with a power drive cleaner is disclosed, the handle being separable for knockdown shipment and thereby also having utility with non power driven cleaners. To this end, a clamping means, fixed to the cleaner, maintains a telescopic engagement of the handle to the cleaner proper, after assembly, while ribs on a rigid bag housing of the cleaner align the handle with the housing during insertion. A split sleeve serves as the clamp and expands the handle into engagement with the cleaner. A much more compact disassembled shipping arrangement, occupying considerably less volume, is achieved by this structure.

10 Claims, 8 Drawing Figures

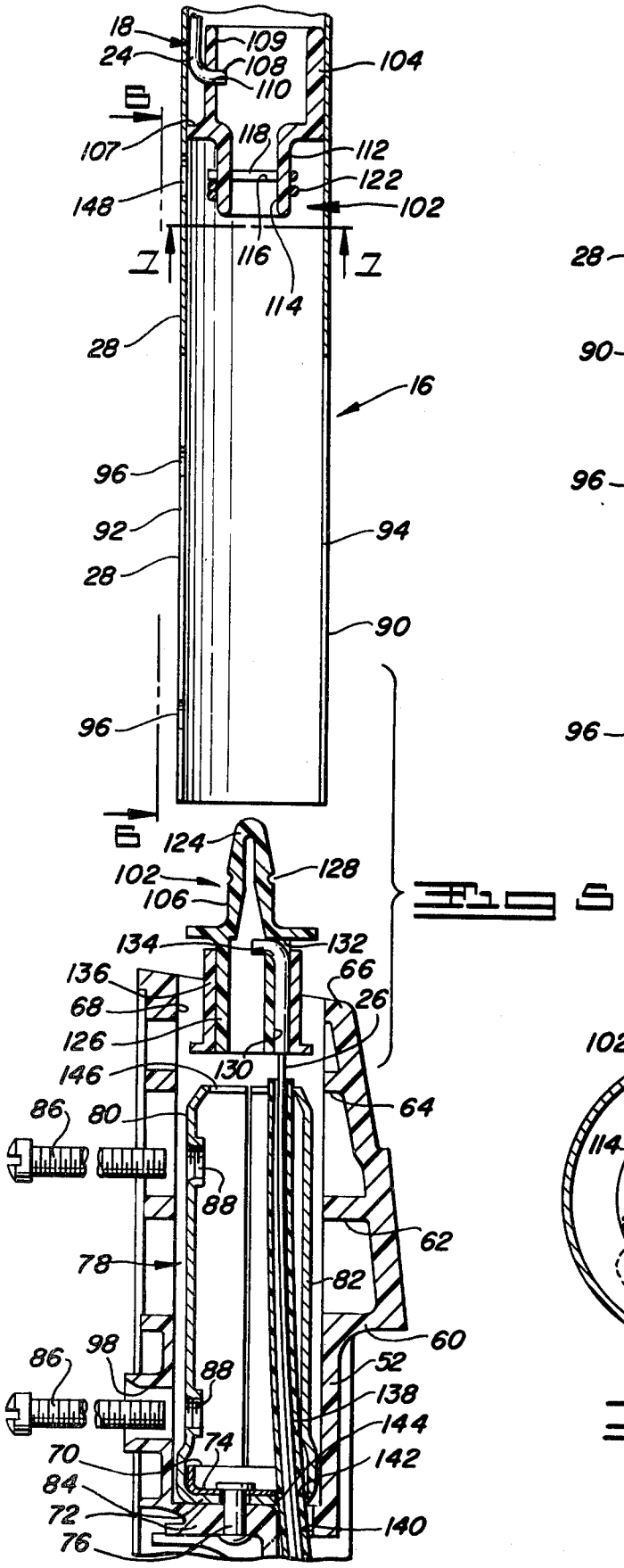
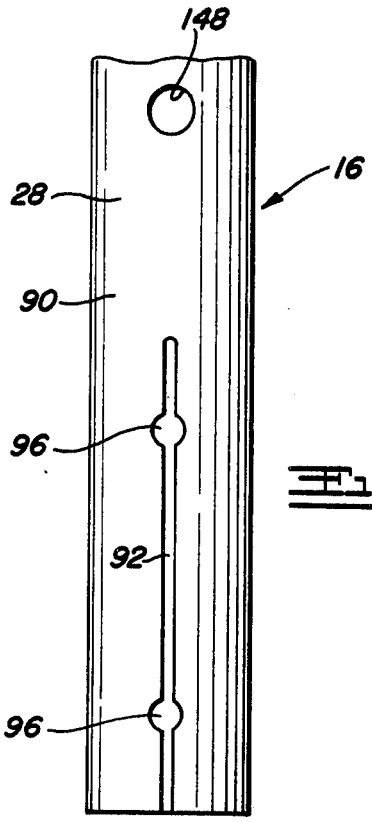
Fig 6
Fig 5
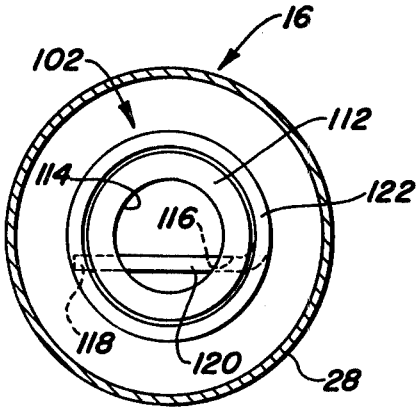
Fig 7

SEPARABLE HANDLE FOR CLEANER

BACKGROUND OF THE INVENTION

1. Field of the Invention

This invention relates to separable handles for cleaners and, more specifically, relates to a separable handle for knockdown shipment which may be used for a power drive cleaner so that it may be assembled therewith after receipt by the purchaser.

2. Description of the Prior Art

Removable handles for knockdown shipment of cleaners are old and well known. Such handles require a cleaner fastening means which often takes the form of a clamping structure or clamping arrangement. These clamping arrangements often featured fairly quick connection but did not also always provide a secure connection, good alignment or an unconcentrated fastening force on the handle.

Accordingly, it would be advantageous to provide an easily assembable handle securely fastened configuration.

It would also be advantageous to provide a connection which fully aligned the handle.

It would be additionally advantageous to utilize a telescopic engagement of the handle to aid initial and automatic alignment.

It would also be advantageous to provide a large area of clamp-bearing surface to prevent concentration of handle induced stress.

SUMMARY OF THE INVENTION

As exemplary, a power drive cleaner utilizing a shiftable clutch mounted in the cleaner housing and including a control means extending from the hand grip portion of a tubular handle downwardly to the housing is provided as a knockdown unit to the customer. This is possible because the cleaner has a quick and easy assembly facilitated by the handle and its contained control means being supplied as one subassembly and the remainder of the cleaner as another.

The handle is telescopically received in a series of annular, integral ribs contained in a hard bag housing of the cleaner, with the ribs serving as an alignment, arrangement for the adjoining ends of the control means contained in the handle and in the hard bag housing. A tubular, split clamp is also disposed in and fixed to the hard bag housing, with the handle telescoping over this clamp as it extends axially between the annular ribs of the housing. This tubular clamp thereby aids in the alignment function of the annular, integral ribs of the hard bag housing.

Before assembly, the control means takes the form of a two piece Bowden wire, with the segments of the Bowden wire being disposed in the hard bag housing and handle, respectively. The adjacent ends of the Bowden wire include connector parts of male and female configuration with each part capturing its particular Bowden wire segment. Because of the relative stiffness of the Bowden wire segments, the attachments formed by hook portions of the segments provides a secure, not easily separated junction with the connector parts.

In the embodiment illustrated, the tubular handle contains the female connector part. This connector part extends axially and telescopically within the handle and has a cylindrical outer surface so as to be guided by the inner, complementary surface of the handle. Adjacent its outer end, it is formed with an open ended, hollow, cylindrical, centered tip of smaller diameter than the main portion of the female connector part. Around this tip portion is wound a spiral spring element which imposes a compressive holding force on the tip portion, tending to make the coils of the spring smaller. A groove is cut through the wall of the tip portion, within which is nested the end turn of the spiral spring. Because of the depth of the groove, part of the end turn extends inwardly into the hollow bore of the tip portion.

The male connector part extends outwardly of the hard bag cover is centered relative to the alignment ribs by its connection to its Bowden wire segment which, in turn, is fixed radially within the hard bag cover by extension through a guide tube mounted in the tubular clamp. A close ended, cylindrical tip portion of the male connector part includes an annular groove extending around its periphery for reception of the last turn of the spiral spring so that the connector parts are lockingly telescoped together.

After insertion assembly of the described connector parts, the handle is fixed to the rigid bag housing by tightening of screw means which expand the split clamp against the handle and the handle against the annular alignment ribs. This secures the handle to the housing. The assembly of the cleaner is then complete, with the mounting of an access cover plate on the upper portion of the rigid bag housing, this plate serving to obscure the split clamp handle jointure and complete the streamlined outline of the power drive cleaner.

BRIEF DESCRIPTION OF THE DRAWINGS

Reference may now be had to the accompanying drawings for a better understanding of the invention, both as to its organization and function, with the illustration being of a preferred embodiment, but being only exemplary and in which:

FIG. 5 is a cross sectional elevational exploded view of a showing similar to that of FIG. 2;

FIG. 6 is an elevational view of the lower portion of the handle taken on line 6—6 of FIG. 5; and FIG. 7 is a bottom plan view of the female connector of the control wire junction taken on line 7—7 of FIG. 5.

DESCRIPTION OF THE PREFERRED EMBODIMENT

Figure 1:
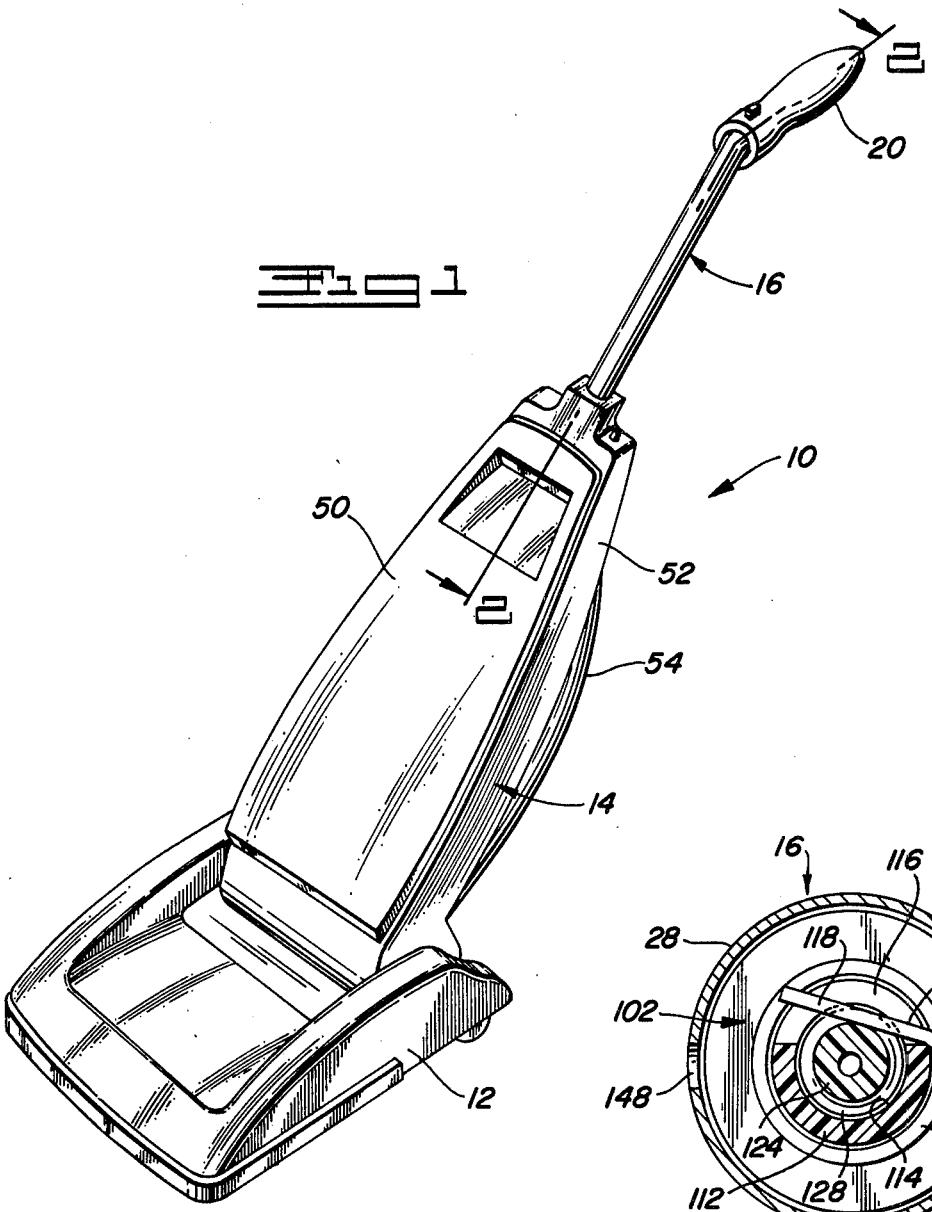
FIG. 1 is a perspective view of a power drive cleaner incorporating the invention.
Figure 3:
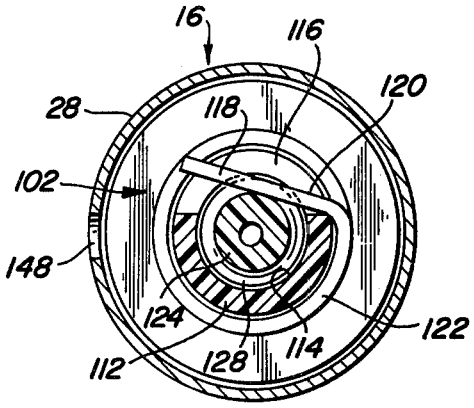
FIG. 3 is a cross sectional plan view of the handle and control wire jointure taken on line 3—3 of FIG. 2 and looking in the direction of the arrows.
Figure 4:
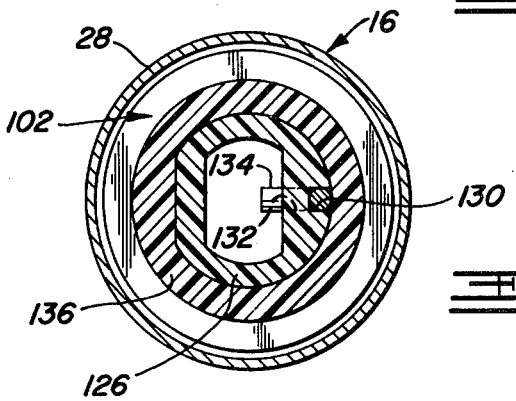
FIG. 4 is a cross sectional plan view of the handle and control wire jointure taken on line 4—4 of FIG. 2 and looking in the direction of the arrows.

With specific reference to FIG. 1, it can be seen that a power driven cleaner 10 includes a wheeled suction nozzle housing 12 and a rigid bag housing 14 conventionally pivoted thereto. A tubular handle 16 of any desired cross section is connected to the rigid bag housing 14 to aid the user in propelling the cleaner 10 over the floor or rugs being cleaned.

Rigid bag housing 14 may enclose a motor (not shown) in its lowermost extent and a disposable bag (also not shown) thereabove that stores dirt picked up by the cleaner 10 during its normal operation. Since the cleaner 10 is power driven the motor is arranged to provide propelling force to a transmission (not shown) located in the wheeled suction nozzle housing 12 and drivingly connected to the supporting wheels for the cleaner 10.

In so far as related, the power driven cleaner 10 is conventional, the same being shown, with its connected power train, e.g., in U.S. Pat. No. 3,618,687, issued Nov. 9, 1971 and owned by a common assignee. Reference may be had to that patent for a more thoroughgoing knowledge of the power drive aspects of power driven cleaner 10, 11 indicating its disposition in the power drive cleaner 10.

As is shown, more specifically, in that patent a control cable or Bowden wire is connected between a slidable hand grip of the power driven cleaner and a slipping clutching mechanism that controls speed and direction. In a similar manner, in the instant invention, a control cable or Bowden wire means 18 (e.g., FIGS. 2 and 2A) is motivated by a slidable hand grip 20, with the Bowden wire extending downwardly within the handle 16 for the power driven cleaner 10 to be attached to a controlling clutch much in the manner of the referred to U.S. patent. Thus, the instant device is functionally and broadly structurally very similar to the disclosed device of that patent.

However, the specific structure provided in the instant device is , on close inspection, very dissimilar in the handle jointure area, since the same provides a separate but easily assembled handle (handle 16) that carries, as a part of its subassembly, an upper Bowden wire portion 24, which connect, respectively to the rigid bag housing 14 and a lower Bowden wire portion 26. The precise structural refinements permitting easy assembly of these elements and insuring proper functioning of them will become apparent as the description proceeds.

Handle 16 is of tubular hollow construction and includes a generally straight axially extending portion 28 which integrally merges at its upper end in an angularly extending portion 30, having an angular disposition relative to the remainder of the handle 16 to provide a comfortable arrangement for grasping by the operator of the cleaner 10. Slidable hand grip 20 is mounted on this axially extending portion and provides a larger more desirable gripping area and also the motivating means for the generally axial movement of the Bowden wire means 18 upwardly and downwardly within handle 16.

Angularly extending portion 30 of handle 16 includes a generally transverse bore 32 extending through its tubular side wall that receives a resiliently outwardly urged button 34, carried by and captured in the handle grip 20. When the handle grip 20 is located on handle 16 so that the button 34 registers with bore 32 (chain dotted position), thumb pressure against button 34 will depress the same and cause its insertion in bore 32 to lock handle grip 20 relative to handle 16. At this location of the hand grip, the power drive cleaner 10 is in neutral with the clutching mechanism (not shown) disengaged so that the wheels of the cleaner 10 are essentially free wheeling.

Figures 2, 2A:
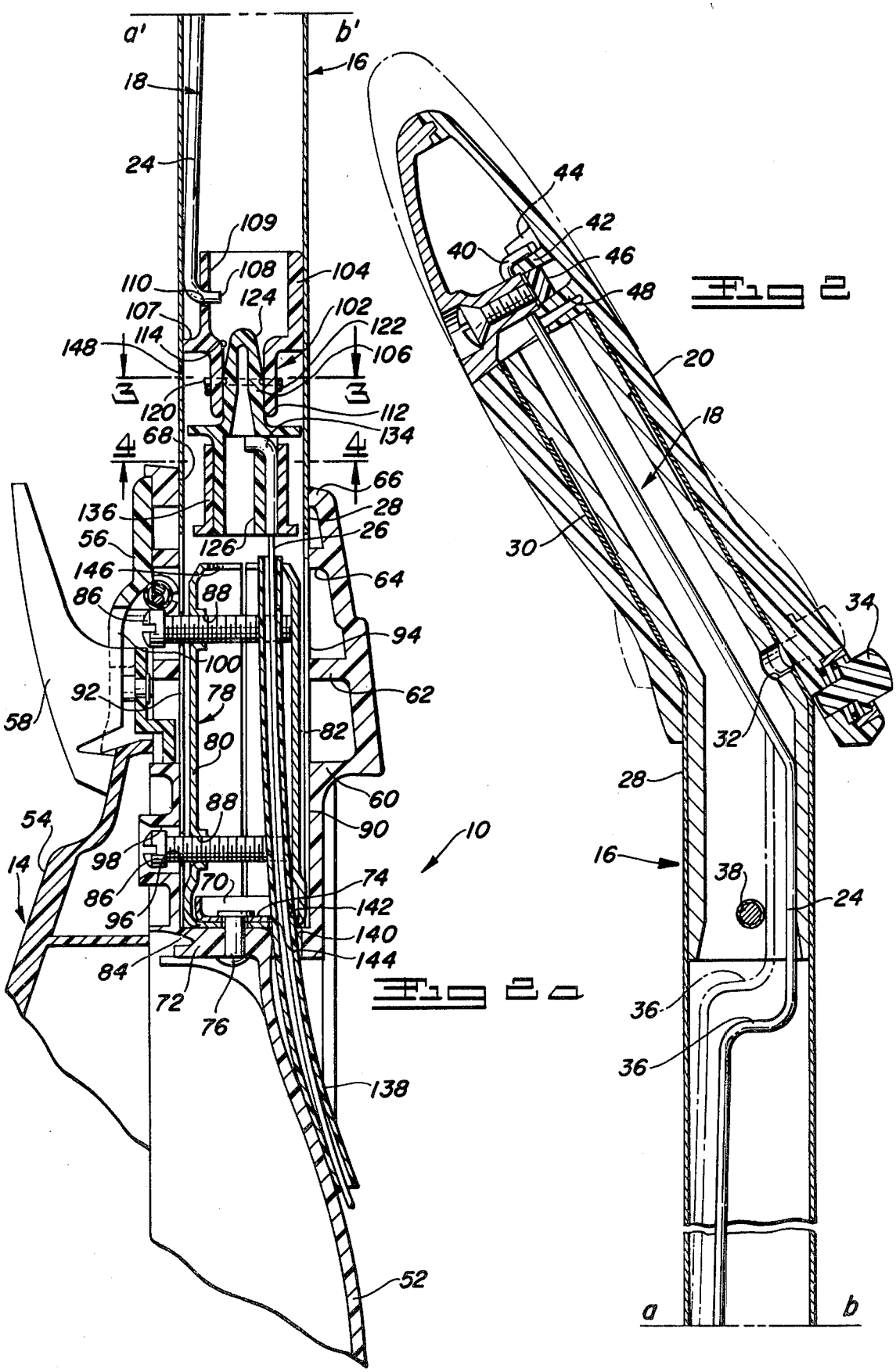
FIGS. 2 and 2A are a cross sectional view of the upper portion of the cleaner including the handle, alignment arrangement and control wire jointure taken generally on line 2—2 of FIG. 1.

In the full line position of FIG. 2, limited by engagement of an internal rib of handle grip 20 with the tubular end of handle 16, the power cleaner 10 is conditioned for forward, maximum acceleration. Although the position of the handle grip 20 relative to handle 16 for reverse drive is not illustrated it should be noted that location of button 34 somewhat rearwardly of bore 32 conditions the power cleaner 10 for reverse drive, with maximum acceleration rearwardly obtained when a transverse extent 36 of Bowden wire portion 24 is adjacent to pin stop 38 fixed relative to handle 16, this pin relieving tension on the Bowden wire when the handle is in upright position.

The upper end of Bowden wire portion 24 must be fixed to sliding handle grip 20 so as to move with the same. This is accomplished by providing Bowden wire portion 24 with a hooked end 40 that engages behind a rib 42 within a slot formed by rib 42 and another rib 44, both formed internally and integral with sliding handle grip 20. A wedging means 46, screw urged between integral rib 42 and another integral rib 48, forces integral rib 42 into compressing relationship with hooked end 40. This compression securely maintains Bowden wire portion 24 fixedly attached with respect to hand grip 20 and at its upper end substantially axially aligned with the angularly extending portion of handle 16. An upper end of the Bowden wire portion 24 is thereby firmly secured while, at the same time, handle grip 20 is mounted with the handle 16 so that it, Bowden wire portion 24 and handle grip 20 can be provided as a portion of the separate handle subassembly.

Rigid bag housing 14 includes a front cover 50 (FIG. 1), a main housing section 52 and a rear cover 54, with the main housing section 52 and rear cover 54 being of generally confronting shell configuration so as to provide a closed volume 56 for housing of a dirt collecting bag (not shown) and with the front cover 50 (shown removed in FIG. 2A), obscuring the downwardly extending lower portion 26 of Bowden wire means 18 and electrical cord (not shown) for the powered cleaner 10. A cover plate 56 disposed above the rear cover 54 and glued to the main housing section 52 completes the general outline of the rigid bag housing 14.

The remainder of the just described housing 14 is maintained in assembled condition in the following manner. The front cover 50 may be, for example, screwed (not shown) to the main housing section 52 for connection thereto, while the rear cover 54 may be hinged (not shown) to the bottom of the main housing section 52 for easy egress to the dirt collecting bag. A latch 58, pivoted to the cover plate 56, maintains the rear cover 54 in closed condition.

The structural arrangement for maintaining the handle 16 mounted to the rigid bag housing 14 includes a series of ribs 60, 62, 64 and 66, integral with main housing section 52, and having circular apertures in the illustrated embodiment which are axially aligned with each other to form a bore 68 through which handle 16 extends to be telescopically received in main housing section 52. The handle 16 is maintained within the bore 68 in the following manner.

A handle retaining member 70 is fixed to a solid section 72, disposed transverse to the major axis of the cleaner and integral with main housing section 52. This section terminates bore 68 and makes the same a blind bore relative to main housing section 52. The handle retaining member 70 is annular in configuration and includes an end piece or cap 74 through which a headed rivet 76 passes that maintains the handle retaining member 70 with its end piece 74 slightly spatially displaced from solid section 72. A split tubular handle mounting bracket 78, which must conform to whatever the cross sectional shape of handle 16, comprising two opposed, hollow, generally semi-cylindrical pieces 80, 82, is trapped within the bore 68 against solid section 72 by handle retaining member 70. This is accomplished by generally semi-circular ends 84, 84, provided on semi-cylindrical pieces 80 and 82, which are placed so as to be disposed "behind" handle retaining member 70 prior to riveting.

The handle mounting bracket 78 acts as a clamping or wedging means to maintain the handle 14 within the bore 68 by the provision of threaded means which tend to separate the halves of the handle mounting bracket so as to expand it outwardly. To accomplish this, a pair of threaded screws 86, 86 are received in threaded, transverse bores 88, 88 formed to extend through the wall of semi-cylindrical piece 80 and spaced axially relative to each other. Turning of the screws 86, 86 inwardly causes their ends to engage against the inner surface of semi-cylindrical piece 82 so that substantially equal and opposite outwardly directed forces are imposed on the halves of split tubular mounting bracket 78 to urge the same against handle 16.

Handle 16, at a housing end 90, includes a pair of diametrically opposed splits formed by slots 92 and 94 in its uppermost and lowermost portions (e.g., FIG. 2A) that extend axially therealong to permit the housing end 90 of handle 16 to easily expand from the expansive forces imposed on it by the split tubular mounting bracket 78 so that same engages the internal surface, forming the bore 68, of the ribs 60, 62, 64 and 66. Sufficient tightening of the screws 86, 86, then compressingly securely maintains the handle 16 between the ribs 60, 62, 64 and 66 and the split tubular mounting bracket 78. A pair of circular apertures 96, 96, centered relative to an imaginary axial center line of slot 92, permit passage therethrough of the screws 86, 86 so that the same may initiate clamping action. Provided bores 98 and 100 in main housing section 52 and cover plate 56, respectively, yield a similar function.

A connecting means 102 is provided to connect the two Bowden wire portions 24, 26, of Bowden wire means 18 together with a female portion 104 of the connecting means attached to Bowden wire portion 24 and a male portion 106 of the connecting means attached to Bowden wire portion 26. The male and female portions are then assembled together to provide Bowden wire means 18.

Female portion 104 of the connecting means 102 is generally annular in configuration and has a circular rim portion 107 so as to telescopically closely nested within handle 16 to be guided by it in its sliding movement. A wall portion 109 of the annular configuration of female portion 104 is somewhat inwardly offset to provide a clearance between it and the handle 16 for the passage of Bowden wire portion 24 axially along a part of its cylindrical peripheral length so that a shaped hook 108 formed on the end of Bowden wire portion 24 may extend through a bore 110 in female portion 104 to maintain these parts fixedly assembled.

The female portion 104 also includes an integral, annular, forward section 112, coaxially located relative to handle 16 and having a centrally located bore 114 for reception of the male portion 106 of the connecting means. A semi-circular annular groove 116 is also formed in this forward section that extends completely through a portion of the wall of the forward section 112. A resiliently inwardly biased end portion 118 of an inner end turn 120 of a coil spring 122 extends across the slot formed by the groove 112 in a segmental manner, with the remaining turns of spring 122 compressingly mounted in closely embracing relationship around forward section 112. The aforesaid spring portion 118 is utilized to lock the connecting means together.

Turning to the male portion 106 of connecting means 102, it can be seen that the same includes a generally bullet shaped projecting portion 124 that extends generally centrally and axially outwardly of the rigid bag housing 14. It is integrally attached to an inner, substantially annular section 126 to complete the outline of male portion 102. The projecting portion 124 includes an annular groove 128 that extends circumferentially therearound, substantially mediate its axial length to thereby provide a receiving means for segmentally extending end portion 118 of end turn 120 of coil spring 122. Because of the radially inward bias of end turn 120 of the coil spring 122 end portion 118 thereof snaps into annular groove 128 when male portion 106 of the connecting means is insertingly assembled with female portion 104 of the connecting means. The locking interengagement arrived at is secured and withstands all normal tension and compression forces imparted to it by the sliding handle grip 20 so that Bowden wire means acts as if it were a single continuous element.

At its other end, male portion of connecting means 102 includes an arrangement for capturing the end of its respective Bowden wire portion 26. Substantially annular section 126 includes an axially extending groove 130 in its surface that extends from the inner end of annular section 126 outwardly to substantially the beginning of the bullet shaped portion 124. At its outer termination a transverse or radially inwardly extending bore 132 is provided that goes completely through the side wall of substantially annular section 126. A hooked end 134 of Bowden wire portion 26 has its longitudinal, axial extent lying within groove 130 and its transverse extent projecting inwardly through bore 132 so that the Bowden wire portion 26 is attached to male portion 106 of connecting means 102. In order to secure this connection a locking sleeve 136 is telescoped over substantially annular section 126 of male portion 106 to trap the extending end of Bowden wire portion 26 therebetween. The locking sleeve 136, in turn, is connected over annular section 126 by, e.g., gluing the same or by an integral snap pin and annular groove connection therebetween (not shown).

Bowden wire portion 26 extends downwardly from male portion 106 of connecting means 102 within handle 16 to be received in a guiding tube 138, extending to the clutch actuating mechanism (not shown) adjacent to wheeled suction nozzle 12. The guiding tube 138 may advantageously have any conventional attachment (not shown) arranged on the back side of main housing section 52 to guidingly lead Bowden wire portion 26 downwardly to its connection with the clutch actuating mechanism.

Within the handle 16, guiding tube 138 extends through a bore 140 in the solid section 72 of main housing section 52 and a bore 142 in the bottom half 82 of split tubular mounting bracket 78 and a bore 144 in the cap 74 of handle retaining member 70. The guiding tube 138 then extends past screws 86, 86 and terminates slightly beyond a large bore 146 formed in the outer terminating portions of the upper and lower halves of split tubular mounting bracket 78. The male portion 106 of connecting means 102 is, of course, disposed closely adjacent to this point.

It should be clear from the foregoing description that a joinable connecting means and assembable handle for a power drive cleaner have been provided which will still function, when assembled, in a satisfactory manner for controlling the shifting of an alternately forwardly and reversely engaging clutch mechanism and that the same is quite adaptable for use in an art existing and, indeed, commercially viable power drive cleaner now in the marketplace.

Assembly, itself, is both easy and convenient even by a relatively unskilled, ultimate purchaser of the power drive cleaner. The handle 16, sliding handle grip 20, Bowden wire portion 24 and its attached female portion 104 of connecting means 102 is provided as one subassembly. The remainder of the cleaner is provided as a second subassembly. To physically unite the two subassemblies, the purchaser merely inserts the handle 26 into the bore 68 formed by ribs 60, 62, 64 and 66 and over the split tubular mounting bracket 78. Because the split mounting bracket is mounted through riveted handle retaining member 70, with some play being provided in the mounting arrangement, the split mounting bracket 78 can move into the substantially precise axial alignment assumed by handle 16 (as directed by ribs 60, 62, 64 and 66). This eases telescoping of the handle 16 over the split mounting bracket 78.

At the same time, movement of the split mounting bracket tends to axially align male portion 106 of connecting means 102 with its female counterpart, as directed by incremental movements of guiding tube 138. Jointure between the connecting means' parts is then effected as the handle 16 telescopes within the ribs and approaches closer and closer towards solid section 72 of the main housing section 52. The bullet shaped end of male portion 106 also tends to act as an automatically acting alignment means during this latter insertion. Upon the matchup of semi-circular groove 116 in the female portion 104 and annular groove 128 in the male portion 106, spring end turn 120 snaps into annular groove 128 in male portion 106 to lock the connecting means 102 in one assemblage. It should be noted that the connector parts, themselves, if required, will accomplish slight turning movement to properly align the screw receiving bores 88, 88 for insertion of the screws 86, 86 within the screw threaded bores.

The purchaser then only has to insert and turn screws 86, 86 inwardly to positively clamp the handle 16 to the rigid bag housing 14 of the power drive cleaner 10. The power drive cleaner 10 is then conditioned for satisfactory operation, with a positive acting, advantageously handle and handle mounted control arrangement easily accessible for actuation by the user-operator of the power drive cleaner.

Disassembly, if desired, is the reverse of the described assembly operation with a bore 148 in handle 16 permitting disengagement of spring end turn 120 to unlock the connecting means 102.

It should be noted that the description given of the handle is exemplary only and that many modifications thereto would obviously occur to one skilled in the art that the same would still fall within the spirit and purview of the invention disclosed.

I claim:

1. In an upright cleaner having a rigid housing extending upwardly from a suction nozzle, the combination including;

(a) an upstanding hollow handle projecting from said rigid housing, (b) a socket in said housing for receiving said handle, (c) a split sleeve member nested within said socket for aligningly receiving said hollow handle, (d) said handle being received within said socket and over said split sleeve member when mounted in upstanding relation relative to said rigid housing, and (e) means for expanding said split sleeve member within said hollow handle so that said handle in turn expands to close fitting relation with the defining walls of said socket to maintain said handle fixed relative to said rigid housing.

2. The upright cleaner having a rigid housing extending upwardly from a suction nozzle as set out in claim 1 wherein;

(a) said means for expanding said split sleeve member comprise means extending transverse to said split sleeve member.

3. The upright cleaner having a rigid housing extending upwardly from a suction nozzle as set out in claim 2 wherein;

(a) said means extending transverse to said split sleeve member comprise at least one threaded shank.

4. The upright cleaner having a rigid housing extending upwardly from a suction nozzle as set out in claim 3 wherein;

(a) said threaded shank is screwingly received in one part of said split sleeve member and bears in expanding relation against the other part of said split sleeve member.

5. The upright cleaner having a rigid housing extending upwardly from a suction nozzle as set out in claim 1 wherein;

(a) said handle includes a split configuration within said socket.

6. The upright cleaner having a rigid housing extending upwardly from a suction nozzle as set out in claim 5 wherein;

(1) aperture means are provided in said handle for the passage of said threaded shank.

7. The upright cleaner having a rigid housing extending upwardly from a suction nozzle as set out in claim 1 wherein;

(a) said split sleeve member is provided with means for loosely mounting it within said socket to permit aligning movement of it relative to said socket and said handle.

8. The upright cleaner having a rigid housing extending upwardly from a suction nozzle as set out in claim 7 wherein;

(a) said means for loosely mounting said split sleeve member permits both transverse and limited pivoting movement of it.

9. The upright cleaner having a rigid housing extending upwardly from a suction nozzle as set out in claim 8 wherein;

(a) said means for loosely mounting said split member includes at least a shank member extending axially relative to said socket.

10. The upright cleaner having a rigid housing extending upwardly from a suction nozzle as set out in claim 9 wherein;

(a) said shank member includes a headed portion and said split sleeve member is capable of limited sliding movement relative to said headed portion.

* * * * *

UNITED STATES PATENT OFFICE

CERTIFICATE OF CORRECTION

Patent No. 4,155,143 Dated 22 May 1979

Inventor(s) Heinz-Siegfried Garbe

It is certified that error appears in the above-identified patent and that said Letters Patent are hereby corrected as shown below:

Column 2, line 12 -- and -- should be inserted after "cover".

Signed and Sealed this

Seventeenth Day of November 1981

[SEAL]

Attest:

GERALD J. MOSSINGHOFF

Attesting Officer

Commissioner of Patents and Trademarks